United States Patent [19]

Yeo

[11] Patent Number: 4,715,022

[45] Date of Patent: Dec. 22, 1987

[54] DETECTION MEANS FOR MUD PULSE TELEMETRY SYSTEM

[75] Inventor: David E. Yeo, Santa Ana, Calif.

[73] Assignee: Scientific Drilling International, Houston, Tex.

[21] Appl. No.: 885,523

[22] Filed: Jul. 14, 1986

Related U.S. Application Data

[63] Continuation of Ser. No. 771,462, Aug. 29, 1985, abandoned.

[51] Int. Cl.[4] ..... G01V 1/40

[52] U.S. Cl. ..... 367/83; 367/84; 340/861; 175/40; 175/48

[58] Field of Search ..... 73/151, 152, 153, 155; 175/24, 25, 40, 48; 181/102; 340/853, 861; 367/81, 82, 83

[56] References Cited

U.S. PATENT DOCUMENTS

| | | | |
|---|---|---|---|
| 2,759,143 | 8/1956 | Arpes | 324/1 |
| 2,810,546 | 10/1957 | Eaton et al. | 255/1 |
| 2,917,704 | 11/1959 | Arpes | 324/1 |
| 2,924,432 | 2/1960 | Arpes | 255/1 |
| 3,077,233 | 2/1963 | Armstrong | 175/45 |
| 3,309,656 | 3/1967 | Godbey | 340/18 |
| 3,488,629 | 1/1970 | Claycomb | 340/18 |
| 3,693,732 | 9/1972 | Sabi | 175/25 |
| 3,716,830 | 2/1973 | Garcia | 340/18 |
| 3,742,443 | 6/1973 | Foster et al. | 340/18 |
| 3,770,006 | 11/1973 | Sexton et al. | 137/499 |
| 3,800,277 | 3/1974 | Patton et al. | 340/18 |
| 3,965,317 | 6/1976 | Gratzmuller | 340/240 |
| 4,014,213 | 3/1977 | Parquet | 73/290 R |
| 4,100,528 | 7/1978 | Bernard | 340/18 |
| 4,166,979 | 9/1979 | Waggener | 325/321 |
| 4,195,531 | 4/1980 | Okamura | 73/123 |
| 4,207,563 | 6/1980 | Soupal | 340/632 |
| 4,224,687 | 9/1980 | Claycomb | 367/83 |
| 4,262,343 | 4/1981 | Claycomb | 367/83 |
| 4,336,564 | 6/1982 | Wisniewski et al. | 361/154 |
| 4,343,188 | 8/1982 | Baker | 73/706 |
| 4,355,280 | 10/1982 | Duzich | 73/745 |
| 4,386,422 | 5/1983 | Mumby | 367/85 |
| 4,403,655 | 9/1983 | Trout | 175/38 |
| 4,428,401 | 1/1984 | Chun | 73/40 |
| 4,562,560 | 12/1985 | Kamp | 367/911 X |
| 4,628,495 | 12/1986 | Peppers et al. | 367/83 X |

*Primary Examiner*—Harvey E. Behrend
*Assistant Examiner*—Brian S. Steinberger
*Attorney, Agent, or Firm*—William W. Haefliger

[57] ABSTRACT

Information is conveyed from a downhole location within a wellbore being drilled by producing pressure and velocity of flow variations from the steady state drilling fluid pressure and velocity of flow so as to set up transient acoustic waves that propagate to the surface through the drilling fluid within the drill string. The acoustic waves are detected at the surface to obtain the propagated information. According to this invention, a simple and reliable method of recovering the propagated information is to monitor the pressure of the gas filled side of the accumulator or desurger device that is coupled to the drilling fluid line adjacent the pump.

13 Claims, 7 Drawing Figures

DETECTION MEANS FOR MUD PULSE TELEMETRY SYSTEM

This is a continuation, of application Ser. No. 771,462 filed Aug. 29, 1985, now abandoned.

BACKGROUND OF THE DISCLOSURE

This invention relates to detecting the fluid particle velocity of flow variations that are produced in a column of drilling fluid, i.e., drilling mud, by downhole signaling apparatus that is located in the region of a drill bit that is engaged in drilling a borehole in the earth.

During drilling of a well, it is desirable to provide information to the driller as to conditions that exist at the bottom of the well. For example, the inclination of the lower portion of the drill string with respect to a vertical reference axis and the azimuthal direction of that inclination are quite important, particularly in directional drilling, in order to assure that the borehole is drilled along an intended path. Similarly, it may be desirable to convey to the surface of the earth information relative to temperature and pressure conditions at the bottom of the hole, the weight that is applied to the bit at a particular instant, and other parameters that are important to the satisfactory completion of the drilling operation.

In the past, much of this downhole information has been obtained by parameter measuring instruments that were lowered into the drill string on a wire line. In many applications it is desirable to avoid the use of a wire line, if at all possible. Accordingly, systems have been devised for conveying information from a downhole location to the surface of the earth by employing pressure pulses, or transient acoustic waves, in the drilling fluid. These pressure pulses propagate upwardly through the column of drilling fluid to the surface where they are detected by a pressure responsive transducer. In some instances, a negative pressure pulse is produced by momentarily bypassing some of the circulating fluid from the interior of the drill string to its exterior. In other types of signaling equipment a positive pressure pulse is produced by closing or restricting a downhole valve through which drilling fluid flows toward the bit. In either case, the surface equipment responds to the momentary variation in drilling fluid pressure that results from actuation of a valve at the downhole location.

One reason that the detection of signaling fluid pressure pulses on the surface has been less successful than hoped is because the drilling fluid line at a well site includes an accumulator or desurger device whose function is to smooth out the pressure surges in the line caused by the piston strokes of the pump. Not only does the accumulator attenuate the pump pressure pulses, but it also attenuates the signaling pressure pulses that are produced downhole. I have found that the sensing method and apparatus of my invention results in optimum detection of signaling pulses in the drilling fluid and completely obviates the problem that limits the usefulness of prior art mud pulse pressure sensing.

SUMMARY OF THE INVENTION

In accordance with the presently preferred embodiment of my invention, I monitor the pressure in the gas filled portion of an accumulator device that is connected on the downhole side of the drilling fluid (mud) pump. As a valve in the downhole signaling apparatus opens and closes, in rapid succession, the restriction to the flow of the mud in the drill string correspondingly decreases and increases, assuming that the valve is a bypass valve. This action creates a transient acoustic wave that propagates up the mud column to the surface. The momentary reduction in the mud flow restriction is accompanied by a momentary increase in flow velocity, and in a momentarily increased volume of flow. It also is accompanied by an momentarily increased volume of flow. It also is accompanied by an increased quantity of drilling fluid flow from the accumulator, thereby causing the gas filled portion thereof to expand. The expansion of the volume of the gas filled portion of the accumulator causes the gas pressure thereof to decrease. A pressure transducer that monitors the gas pressure of the accumulator thus is a simple and effective detector of the variation of fluid particle flow in the mud column. In effect, the accumulator and pressure monitor connected thereto are functioning as a transducer that converts drilling fluid acoustic particle velocity changes to pressure changes.

BRIEF DESCRIPTION OF THE DRAWINGS

The invention will be described in connection with the accompanying drawings wherein.

DESCRIPTION OF THE PREFERRED EMBODIMENTS

Figure 1:
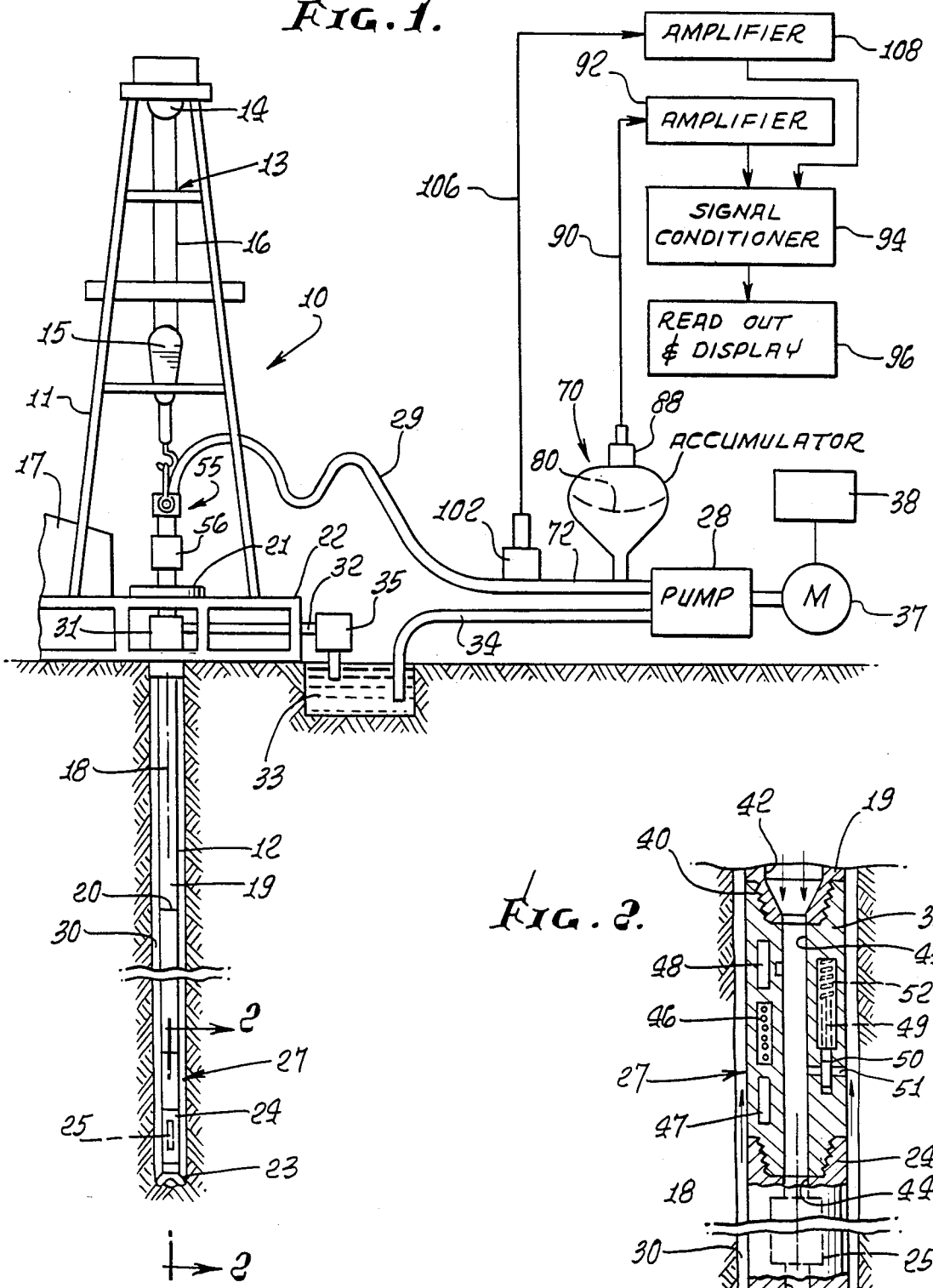
FIG. 1 is a simplified illustration of a well drilling rig provided with telemetry apparatus constructed and arranged in accordance with the present invention.

In the simplified illustration of FIG. 1, a well drilling rig, which is conventional in most respects, includes the usual upwardly projecting derrick or mast 11 from which a drill string 12 is suspended by a block and tackle assembly 13 which includes a crown block 14 and a traveling block 15 suspended from the crown block by a line 16. Drawworks 17 actuates line 16 to move the traveling block and drill string upwardly and downwardly along a vertical axis 18. The drill string is formed of a series of tubular pipe sections 19 threadedly interconnected at joints 20. For purposes of the present invention the drilling apparatus may be of a type in which the entire string is rotated by a rotary table 21 mounted on the rig floor 22, or of a type in which the string is stationary and only the drill bit 23 at its lower end rotates. FIG. 1 is intended to illustrate that latter arrangement, with the lowermost section 24 of the drill string containing a motor 25 of known type adapted to be driven by the drilling fluid circulating downwardly through the drill string to turn bit 23 about vertical axis 18. Connected into the string above the bottom motor section 24 is an instrument section 27 that develops and transmits the monitored downhole information to the surface of the earth.

The drilling fluid, or mud, is delivered under pressure by a pump 28 through a line and flexible hose 29 to the upper end of the drill string 19. The mud then flows downwardly through the interior of the drill string to bit 23. The fluid is discharged through restricted passages in the bit to the outside of the string, and then returns to the surface through the annulus 30 between the drill string and the borehole. At the upper end of the well the returning fluid received from annulus 30 is confined within a structure 31 and is discharged through a line 32 to a collection sump 33. Pump 28 takes suction through a line 34 for recirculation of the mud to the drill string. Before recirculation of the mud, cuttings and other unwanted materials are separated out by a screen, filter or other separation system represented diagrammatically at 35.

Pump 28 is a conventional mud pump of the positive displacement type, typically including one or more piston and cylinder mechanisms. The pump is driven by a motor 37 at a rate which can be varied by control means 38.

Figure 2:
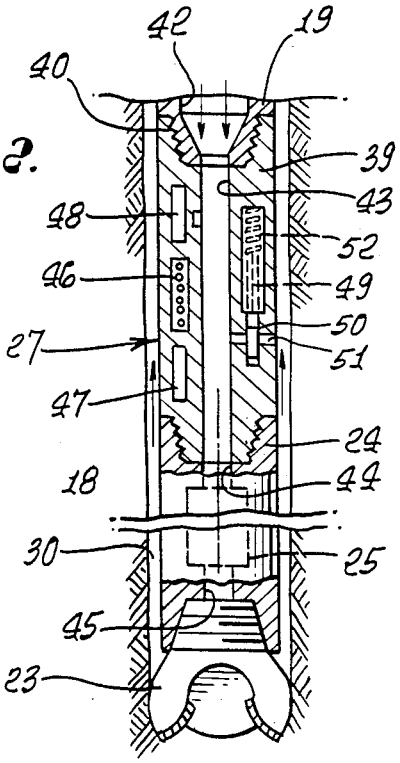
FIG. 2 is a simplified illustration of a downhole tool of a type used in a measuring while drilling operation.

FIG. 2 is a simplified illustration of the downhole tool. It forms no part of my invention but is illustrated in simplified form herein to assure a complete understanding of the background of my invention. The instrument or tool section 27 of the drill string has a rigid tubular body 39 centered about axis 18 of the string and its upper end is threadedly connected at 40 to the next upper section 19 of the string. Its lower end is threadedly connected at 41 to the lowermost section 24 of the string that carries the mud motor. Drilling fluid flows downwardly from a passage 42 formed in the string above instrument section 27 into an axial passage 43 formed in body 39. From the lower end of passage 43 the fluid flows into a passage 44 in bottom section 24 to drive motor 25. The fluid then is discharged into annulus 30 through a passage represented at 45.

The active elements of instrument section 27 of the string are illustrated within cavities formed in the relatively thick sidewall of body 39 of section 27 and may include an instrument 46 adapted to sense a condition or conditions in the well, battery pack 47 for energizing the instrument and other related parts, an electronic circuit 48, and an electrically operated device 49 for actuating a valve 50 between open and closed positions. Valve 50 acts to control flow of the circulating drilling mud from passage 43 through a passage 51 in the side wall of body 39 to the exterior of that body. The valve 50 may be a gate valve which is actuable vertically between its closed and open positions in which it blocks flow of drilling mud laterally from passage 43, or permits the fluid to bypass laterally through passage 51 to the annulus 30 about body 39 without flow through motor 25 and the bit. The actuator 49 for valve 50 may be a solenoid which opens the valve when energized and permits closure of the valve by a spring represented at 52 when the solenoid is deenergized. Other arrangements of instrument sections are known and may be used.

Each time valve 50 is opened in response to coded information signals the bypassing of drilling mud through passage 51 from the interior of body 39 to its exterior reduces the restriction to flow of the mud down the drill string, thereby allowing the drilling mud to flow down the string at a greater velocity and with an accompanying reduction in fluid pressure in the mud column. These are the so called "mud pulses" that are detected at the surface to recover the transmitted information. In fact, the mud pulses are transient acoustic waves that propagate through the mud column in the drill string.

A number of different methods and apparatus have been proposed for detecting the mud pulses. For example, it is known to mount a pressure transducer 102 on the pipe 72 that connects the mud pump and accumulator to the drill string. Additionally, in U.S. patent application Ser. No. 330,836 entitled Well Information Telemetry, filed Dec. 15, 1981, by H. Moll, and assigned to applicant's assignee, a telemetry system is disclosed in which optical, ultrasonic or mechanical means are utilized at the surface to monitor the velocity or flow rate of the drilling fluid in order to detect the information pulses produced downhole in the instrument section 27. That system is attractive, but the information receiving means of my invention is simpler to construct and produces better quality information at the surface.

Figure 3:
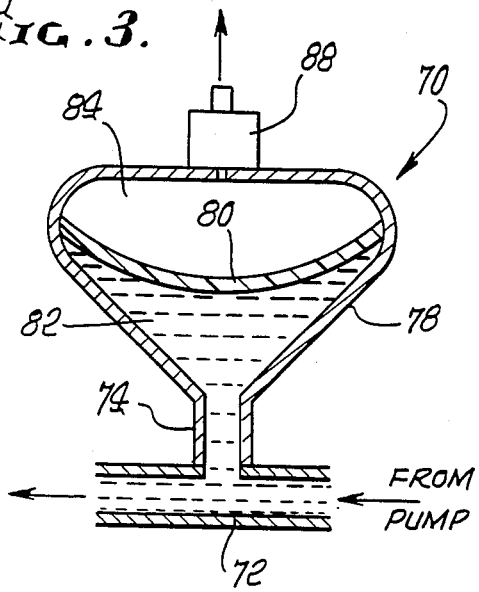
FIG. 3 is a simplified illustration of an accumulator device that is used in the apparatus of FIG. 1.

The implementation of my invention is illustrated in simplified form in FIGS. 1 and 3 wherein the accumulator 70 that is commonly employed in a mud circulating system is illustrated as coupled to pipe 72 that in turn is connected to the output port of mud pump 28. As is well understood, the accumulator functions to smooth out the pressure pulses in the mud line that are caused by the piston strokes of the mud pump. The accumulator sometimes is called a desurger.

Accordingly, a relatively more steady state pressure and velocity of flow are established in the drilling fluid line. As illustrated in simplified form in FIG. 3, accumulator 70 is connected to pipe 72 by means of a short vertical section of pipe 74. Accumulator 70 has an enclosed body 78 that is hollow except for a flexible diaphram or septum 80 secured within the body of the accumulator to provide two isolated interior regions or portions. The first region 82 is coupled to pipe 72, and mud under pressure from pump 28 flows into this first region. The other region 84 on the opposite side of the diaphram 80 is filled with a given quantity of inert gas such as nitrogen. Diaphram 80 is flexible and gas impervious so that it will move to either side of an equilibrium position in response to the quantity of mud within region 82 of the accumulator. As more mud is introduced into the accumulator, diaphram 80 is displaced upwardly and the gas in upper portion 82 is correspondingly compressed. On the other hand, when a quantity of mud flows out of accumulator 70 the force of the mud on diaphram 80 is reduced and the gas expands within portion 84 to force the diaphram 80 downwardly to maintain contact with the mud. The gas is bound within the second portion 84 of the accumulator so that its pressure varies as a function of the amount of mud in the first section 82. In terms of its acoustic properties, diaphram 80 is an acoustically compliant medium.

As previously stated, when mud porting or venting valve 50, FIG. 2, is open to divert mud from within the drill string, the resistance to flow of mud within that string is decreased and the velocity of flow of the mud in the drill string increases. Because mud pump 28 may be considered to be a constant volume pump, during the time signals are produced downhole, the increased velocity of flow of mud particles in the drill string results in at least a portion of the mud within the first portion 82 of accumulator 70 flowing into the pipe 72 that leads to the drill string. This flow of mud out of the accumulator permits the gas in the second portion 84 to expand with an accompanying decrease in its pressure. Pressure transducer 88 is mounted on accumulator 70 so as to be in contact with the second portion 84 of the accumulator for monitoring the gas pressure therein. In this manner the pressure transducer 88 that monitors the pressure on the gas side of diaphram 80 will produce output signals corresponding to the flow of mud into and out of the other side of the accumulator in response to the changing velocity of flow in the drill pipe that is produced by the signaling pulses. It should be understood that the mud pulsing that is produced in instrument section 27 may be negative pulses as described, or they could be positive pressure pulses that result from a different valve arrangement in the instrument section. Both systems are well known and need not be further described. In a strict sense, what is being measured is the variation from steady state in the acoustic wave fluid particle velocity of flow of the mud into and out of accumulator 70 resulting from the signal pulses produced downhole.

It is thus seen that by the simple expedient of placing a readily available pressure transducer on the gas filled side of the accumulator a reliable signal is obtained that is indicative of the variation in the acoustic wave fluid particle velocity in the mud flow in the drill string.

As illustrated in FIG. 1, the electrical output signal of pressure transducer 88 may be coupled over lead 90 to an amplifier device 92, and then through a signal conditioning means 94 to an appropriate readout and display device 96. This readout and display device 96 is available to the driller to guide him in his drilling operation. If desired, additional information may be obtained from a pressure transducer 102 that is coupled directly to pipe 72 on the downstream side of accumulator 70. This additional information is coupled over a lead 106 to an amplifier 108 and may be utilized in an appropriate manner.

Figure 4:
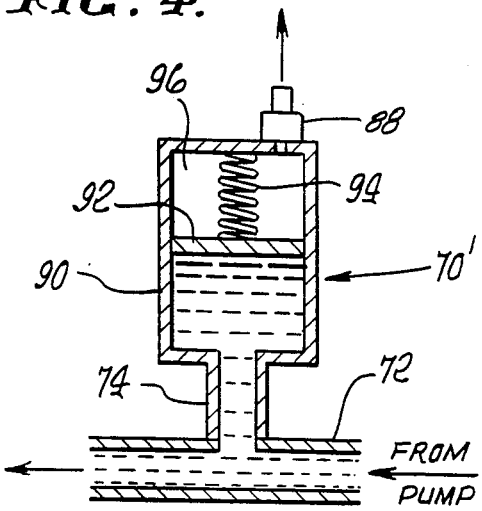
FIG. 4 is a simplified illustration of an alternative type of accumulator that may be used in the apparatus of FIG. 1.

The type of accumulator illustrated in FIG. 3 and described above is one example of a transducer that can be used in accordance with the teachings of this invention. Accumulators having other types of construction are known and could be used in practicing this invention. In FIG. 4, for example, the accumulator 70 could be a closed cylindrical member 90 that is connected to pipe 72 by means of the short vertical section of pipe 74. Mud from the pump (not illustrated) enters vertical pipe 74 and the bottom portion of cylindrical body 90 and exerts a force against a piston member 92. Piston member 92 moves upwardly within cylindrical member 90 in response to a force from the mud on one side, and moves downwardly in response to a spring member 94 on the opposite side. Piston member 92 will be at some intermediate position within cylindrical member 90 under the normal steady state pressure and velocity flow in mud line 72. As the velocity of flow of mud into and out of the cylindrical member 90 changes in response to changes in the velocity of mud flow in the drill string, as described above, piston member 92 will raise and fall to cause the upper gas filled region 96 of the cylindrical member to become larger or smaller. This causes the pressure of the gas within the upper portion 96 to increase or decrease in response to the signal pulses in the mud line. Pressure sensor 88 is in communication with the gas filled region 96 of cylindrical member 90 and produces an output signal that is a function of the gas pressure and of the flow velocity variation of mud in the drill string.

Instead of measuring the gas pressure in the top portion 96 of accumulator 70', means such as a strain gauge may be provided for measuring the strain in the spring means 94 to provide an indication of the fluid particle velocity of mud flow. Similarly, in FIG. 3, although not presently preferred, strain gauges could be secured to diaphram 80 to provide the desired output signal in place of the use of a gas pressure gauge 88.

As an alternative to the conventional accumulator, a simple standpipe that is at least partially filled with mud also could be used as the transducer. Means could be provided for determining the height of the mud in the column, thereby providing a transducer whose output signal contain pulses corresponding to the mud pulsing produced by the instrument section of the downhole tool. This points out another feature that would be possible with the embodiments of FIGS. 3 and 4. That is, a separate diaphram 80 or piston 92 would not be absolutely necessary. The gas pressure will act directly against the mud in the round body members 78 and 90, and vice versa. However, at the present time a separate diaphram or piston is preferred.

As a further alternative to the diaphram 80 and pressure transducer 88 of FIG. 3, an ultrasonic transducer and associated circuitry for ultrasonic pulse echo ranging could be mounted at the top of the accumulator illustrated in FIG. 3 as a means for detecting the level of the mud in the device. Furthermore, appropriate mechanical means such as float level detectors could be used as an indication of the level of mud within the accumulator. The position of the float level detector would be correlated to mud acoustic particle velocity flow and/or pressure of mud in the drill string.

Figure 5:
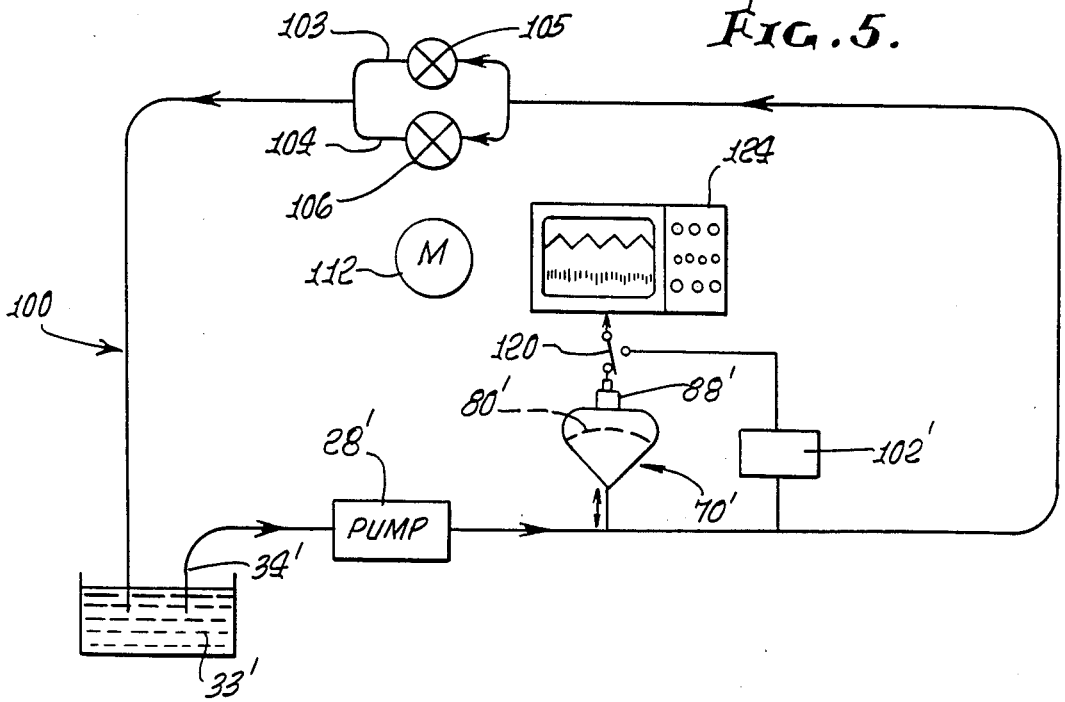
FIG. 5 is a simplified diagram of an experimental test system that demonstrated the principle of my invention.

The improved performance that is achievable with mud pulsing telemetry system of this invention was confirmed in an arrangement that is illustrated in simplified form in FIG. 5. Two inch diameter tubing was connected in a closed loop 100 for circulating drilling fluid from collection sump 33' around the loop. The drilling fluid that was used included a commonly available drilling mud that had a density of 9.5 pounds per gallon and a viscosity of 17 CPS. Pump 28' was a model P323, triplex plunger pump, manufactured by Wheatley Division of Geosource Incorporated, Tulsa, Oklahoma. The pump was operated at 330 revolutions per minute and had a flow rate of 54 gallons per minute. Accumulator 70 was a model number NS 2373 10-51, a product of Greer Hydraulics Inc. At the top of loop 100 of FIG. 5, the fluid path divides into parallel paths 103 and 104. Path 103 includes a throttle valve 105 that helps to establish the steady state flow within loop 100. Path 104 includes a valve 106 that is actuated by motor 112 to continuously open and close at a fixed rate. Valve 106 was operated at a rate of approximately two cycles per second, and at a 50% duty cycle to produce 25 psi negative pressure pulses when the valve was opened. Accumulator 70' includes a flexible, gas impervious diaphram 80' that provides a mud filled portion at the bottom of the accumulator and a gas filled portion at the top thereof. Pressure transducer 88' measures the gas pressure in the top portion of accumulator 70' and produces an electrical output signal that is coupled through switching means 120 to an oscillocope 124.

A fluid pressure transducer 102' is coupled directly to the loop 100 and monitors the pressure of the mud within the loop. The electrical output on pressure transducer 102' may be selectively coupled to oscilloscope 124 through the switching means 120.

Figure 6:
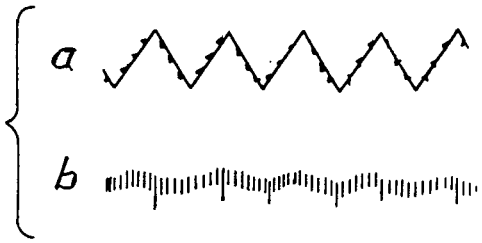
FIG. 6 and 7 are illustrations of waveforms of signals obtained from the pressure transducers of FIG. 5.

With the mud pulsing valve 106 operating as described above, the output signal from pressure transducer 88' on the gas filled side of accumulator 70' is illustrated in the oscilloscope trace of FIG. 6*a*. This trace shows a very regular sawtooth waveform having a two Hz repetition frequency. The 16.5 Hz signal representing the pressure variations from the triplex mud pump 28' is bearly discernable on the sawtooth waveform. On the other hand, the output signal from pressure transducer 102' that is directly monitoring the mud pressure within loop 100 is illustrated in the oscilloscope trace of FIG. 6*b*. In this waveform, the two Hz pressure pulses produced by mud pulsing valve 106 are bearly discernable and are manifested only as a small spike at each valve opening and a slight undulation of waveform.

Figure 7:
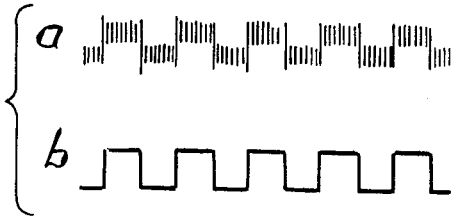

FIG. 7*a* is an oscilloscope trace of the output of pressure transducer 88' on accumulator 70' when the output of the transducer has been differentiated prior to coupling to the oscilloscope. The 50% duty cycle square wave pulses are clearly discernable, and the higher frequency piston strokes of pump 28 are clearly discernable on the waveform. The waveform of FIG. 7*a* may be filtered to remove the higher frequency pump piston stroke signals and to leave only the 50% duty cycle square wave resulting from mud pulsing valve 106, as illustrated in FIG. 7*b*.

Reasons why difficulties have been encountered in the past in receiving good and reliable mud pulsing signals at the surface, and the reasons why the present invention is successful, may become evident to some by analyzing the drilling fluid column from pump 28 to the drill bit 23, FIG. 1, as an acoustic transmission line. The mud pump 28 has the characteristics of an open circuit at the end of the transmission line, and accumulator 70 may be considered to be analogous to a Helmholz resonator, that is, a means that manifests acoustic compliance. The purpose of the accumulator 70 is to smooth out the pressure surges caused by the piston strokes of the pump. The accumulator does its job best when its resonance frequency is equal to the frequency of the piston strokes of motor 28, which in practice might range from 1 to 9 Hz, as an example. The resonant accumulator may be considered as a short circuit across the end of the transmission line or, more realistically, as a very low impedance, relative to the characteristic impedance of the acoustic transmission line.

In transmission line theory, pressure pulses in an acoustic transmission line are analogous to voltage pulse in an electromagnetic transmission line, and acoustic particle velocity fluctuation around the steady state velocity of drilling fluid resulting from the pressure pulsing is analogous to current pulses in the electromagnetic transmission line. The accumulator is analogous to a series resonant RLC circuit. Consequently, the very low impedance presented by the accumulator at resonance means that there is a very low pressure present at the end of the transmission line. (Because the frequency of the piston strokes of the mud pump and the frequency of the mud pulsing signals from downhole both are extremely low and the wavelengths are extremely long, actual separations between the mud pump and the accumulator, and between the mud pump and drill string at the top of the borehole, are extremely small fractions of the acoustic wavelength and for practical purposes can be considered to be at the end of the transmission line.)

With the above explanation it is seen that any mud pulse signaling rate near the resonant frequency of the accumulator inherently will produce low magnitude pressure pulses at the surface. On the other hand, in the present invention, the mud particle velocity fluctuation at the end of the transmission line will be optimum since it corresponds to electrical current at a short circuited transmission line.

The acoustic characteristics of accumulator 70, the properties of the acoustic transmission line comprised of the drilling fluid line and drill string, and the mud pulse repetition rate must be proportioned according to the theory of resonance, transmission line theory, and the equivalent structures present to select the optimum type of accumulator and most advantageous repetition rate. Inasmuch as accumulator 70 is performing a dual function of a pressure pulse smoother and as an acoustic signal transducer, it is possible, and may even be advantageous, to use two instead of one accumulators connected to fluid line 72. In this instance, the first accumulator may have charactertics that optimize its performance as a pressure pulse smoother or surge preventer, and the second accumulator may have characteristics that optimize its performance as an acoustic signal transducer.

In its broader aspects, this invention is not limited to the specific embodiment illustrated and described. Various changes and modifications may be made without departing from the inventive principles herein disclosed.

I claim:

1. In apparatus transmitting signals from within a well bore to the surface, and for detecting such signals, there being a drill pipe string and rotary bit means in the well bore, the combination comprising (a) first means for supplying a stream of drilling fluid to the drill pipe string for flow downwardly in the bore as a down stream, said first means including a flow line and a fluid pump connected with said line and operable to pressurize said drilling fluid, (b) structure in the well bore and to which said drill string is connected for passing drilling fluid to the bit means, the fluid then flowing back up the well bore in a return stream, (c) a first passage associated with said structure for diverting flow of some of the drilling fluid, and a valve associated with said structure and operable to interruptedly control flow of diverted fluid, via said passage, thereby to produce pulses in said down stream, the pulses traveling upwardly to fluid in said line, and characterized as providing acoustic particle velocity changes, (d) an instrument associated with said valve, in the bore, for controlling said operation of the valve as a function of data to be transmitted to the surface, (e) an accumulator connected with said line and defining a chamber into which said pulses are transmitted, the accumulator including a diaphragm in said chamber, one side of the diaphragm contacted by said fluid, and there being second fluid at the opposite side of the diaphragm and to which said pulses are transmitted via the diaphragm, the diaphragm movable to different positions in the chamber in response to operation of the pump, (f) the pump producing pulsations in the drilling fluid in the line between the pump and the accumulator and at a first pulsation frequency $f_1$, the accumulator filtering said pulsations to reduce their amplitudes in the drilling fluid between the accumulator and the bit means, the valve operating to produce said pulses having a second frequency or frequencies substantially greater than $f_1$ in the drilling fluid between the valve and the accumulator, (g) and a first pressure tranducer located to detect said pulses in the second fluid, irrespective of the position of the diaphragm in response to operation of the pump, (h) the accumulator and transducer together providing a means for converting changes in acoustic particle velocity into pressure changes.

2. The apparatus of claim 1 wherein said second fluid comprises gas, and said transducer is located to sense pulses in the gas, at a location spaced from diaphragm excursions.

3. The apparatus of claim 1 wherein said pump produces pressure pulsations in the first fluid at a frequency substantially less than the frequency of the pulses produced by said controlled operation of the valve, the accumulator acting to filter the pump produced pulsations in the first fluid stream via which the valve produced pulses travel to the accumulator.

4. The apparatus of claim 1 including a second and vertical passage in said structure for passing drilling fluid continuously downwardly to the bit, the second passage in communication with the first passage and intersecting it laterally.

5. The apparatus of claim 1 wherein said first passage discharges to the exterior of said structure, at a location above the level of the bit.

6. The apparatus of claim 1 including (i) amplifier means connected with said transducer to amplify signals produced by the transducer in accordance with pulse detection, and (ii) read-out and display means, and (iii) signal conditioning means connected between the amplifier means and said read-out and display means.

7. The method of claim 1 wherein the transducer has an electrical signal output, and including amplifying and conditioning said signal output, and displaying the amplified and conditioned output.

8. The method of claim 1 including operating a second transducer to detect pulses in said line, downstream of the accumulator, both transducers having electrical signal output, and processing the signals from both transducers to obtain an enhanced signal readout.

9. The apparatus of claim 1 including a second pressure transducer connected into said line downstream of said accumulator to detect pulses in the drilling fluid between the accumulator and the drill string.

10. The apparatus of claim 9 including (i) amplifier means connected with said first and second transducers to amplify signals produced by the first and second transducers in accordance with pulse detection thereby, (ii) read-out and display means, and (iii) signal conditioning means connected between the amplifier means, and said read-out and display means.

11. In the method of transmitting signals from a well bore to the surface, and for detecting such signals, there being a drill pipe string and rotating rotary bit means in the wellbore, and employing apparatus that includes:

(a) first means for supplying a stream of drilling fluid to the drill pipe string for flow downwardly in the bore as a down stream, said first means including a flow line and a fluid pump connected with said line and operable to pressurize said drilling fluid, (b) structure in the well bore and to which said drill stirng is connected for passing drilling fluid to the bit means, the fluid then flowing back up the well bore in a return stream, (c) a first passage associated with said structure for diverting flow of some of the drilling fluid, and a valve associated with said structure and operable to interruptedly control flow of diverted fluid, via said passage, thereby to produce pulses in said down stream, the pulses traveling upwardly to fluid in said line, (d) an instrument associated with said valve, in the bore, for controlling said operation of the valve as a function of data to be transmitted to the surface, (e) an accumulator connected with said line and defining a chamber into which said pulses are transmitted, the accumulator including a diaphragm in said chamber, one side of the diaphragm contacted by said fluid, and there being second fluid at the opposite side of the diaphragm and to which said pulses are transmitted via the diaphragm, the diaphragm movable to different positions in the chamber in response to operation of the pump, (f) and a first pressure transducer located to detect said pulses in the second fluid, irrespective of the position of the diaphragm in response to operation of the pump, said method further including the steps (i) supplying said stream of drilling fluid to said first means, including operating said pump to produce pulsations in the drilling fluid in said line between the pump and the accumulator, and at a first pulsation frequency $f_1$, the accumulator operating to filter said pulsations to reduce their amplitudes in the drilling fluid stream between said accumulator and the drilling bit, (ii) and operating said valve to produce said pulses having a second frequency or frequencies substantially greater than $f_1$, in the drilling fluid stream between the bit means and the accumulator, (iii) the transducer and accumulator together converting fluid particle velocity changes into pressure changes.

12. The method of claim 11 including passing said diverted flow of drilling fluid to the exterior of said structure and into the drilling fluid flowing upwardly about the drill string.

13. The method of claim 11 wherein said second fluid comprises gas, and including operating the transducer to sense pulses transmitted into the gas from the first fluid in the accumulator.

* * * * *